US005743517A

United States Patent [19]

Bergeron

[11] Patent Number: 5,743,517

[45] Date of Patent: Apr. 28, 1998

[54] LOOSE SIGNATURE EJECTOR ASSEMBLY IN A FOLDING APPARATUS

[76] Inventor: Eugene John Bergeron, 885 State St., Portsmouth, N.H. 03801

[21] Appl. No.: 645,855

[22] Filed: May 14, 1996

[51] Int. Cl.[6] ..... B42C 1/00

[52] U.S. Cl. ..... 270/45; 270/47

[58] Field of Search ..... 270/45, 47

[56] References Cited

U.S. PATENT DOCUMENTS

| | | | |
|---|---|---|---|
| 4,508,528 | 4/1985 | Hirsch et al. | 270/45 |
| 4,905,977 | 3/1990 | Vijuk | 270/45 |
| 5,090,671 | 2/1992 | Gombault et al. | 270/45 |
| 5,108,082 | 4/1992 | Shea et al. | 270/45 |
| 5,125,633 | 6/1992 | Fecker et al. | 270/45 |

*Primary Examiner*—John T. Kwon
*Attorney, Agent, or Firm*—Kenyon & Kenyon

[57] ABSTRACT

A signature ejecting assembly for use in a folding apparatus in a printing press. A first rotatably mounted surface is provided, and a second rotatably mounted surface is movingly mounted on a bracket. The first and second rotatably mounted surfaces located within the product transfer area or nip of the folding apparatus. The second rotatably mounted surface exerts a positive drive force upon loosely held or bunched signatures during start-up, thereby ejecting the signatures and preventing jams in the folding apparatus.

9 Claims, 5 Drawing Sheets

24
25
5
1
9
7
13
8
11
3
10
18
4
14
20
30
19
21
16
15
12
17

LOOSE SIGNATURE EJECTOR ASSEMBLY IN A FOLDING APPARATUS

BACKGROUND OF THE INVENTION

1. Field of the Invention

The present invention concerns a device for use in a folding apparatus of a rotary printing press, for ejecting loose or bunched signatures, thereby preventing jams.

2. Description of the Prior Art

U.S. Pat. No. 4,521,007 shows a braking brush used in a folding apparatus of a rotary printing press. The folding apparatus as disclosed in that patent includes a puncturing or first product guiding cylinder 3 which grips individual signatures 6 and guides the signatures to a folding or second product guiding cylinder 8. The braking brush assembly of that patent uses braking brushes for stretching signatures 6 which are conveyed in a given direction on the folding cylinder 8.

The braking brushes 11 used in the apparatus of U.S. Pat. No. 4,521,007 are disposed individually at each folding cylinder 8, are curved to match the curvature of the folding cylinder 8, and are distributed over the length of the folding cylinder 8. The apparatus also includes a spindle 19 and a cross bar 18 extending transversely to the direction in which the signatures 6 are conveyed. The braking brushes 11 are movably fastened at a lower end to the spindle 19 and at upper ends to the cross bar 18. Levers 15 press the braking brushes 11 to a greater or lesser extent selectively against the signatures 6 conveyed on the cylinder.

SUMMARY OF THE INVENTION

It is an object of the present invention to provide an apparatus allowing loose or bunched signatures produced during start-up of a rotary printing press to be ejected from the folder before entering the nip, thereby preventing jams. A further object of the present invention is to provide for positive drive and handling of signatures which are only loosely restrained during start-up.

The apparatus of the present invention is a signature ejecting device in a folding apparatus, which ejecting device includes a first driven rotating surface and a second rotatably mounted surface movably mounted on a bracket. The first and second rotatably mounted surfaces are located in a product transfer area of the folder and the second rotatably mounted surface exerts a positive drive upon loosely held or bunched signatures, particularly during start-up. This arrangement allows removal of signatures from the folding apparatus which would otherwise cause a signature jam in the product transfer area, since during start-up such loosely restrained signatures would not be positively held by grippers on the first product guiding cylinder of the folder. Because a continuous stream of signatures are delivered to the product transfer area of the folder, signatures not correctly transferred must be conveyed out of the product transfer area to prevent jamming of the signature stream. The present invention accomplishes that result by providing a nip and a positive drive to eject signatures which would otherwise bunch and jam.

A further advantage of the present invention is that only temporary contact between the second rotatably mounted surface and the driven surface is needed. The driven surface can be a roller already present in the folding apparatus, such as a conveyor tape roller.

The second rotatably mounted surface can be either a rubber roller, a plurality of disc-shaped elements, or a belt.

Each of these elements can be driven by friction when in contact with the driven surface.

Actuation of the actuating lever where the second rotatably-mounted surface is mounted can be accomplished by a pneumatic cylinder, an encapsulated hydraulic cylinder, solenoids, an electric motor, or actuating spindles driven by a motor.

BRIEF DESCRIPTION OF THE DRAWINGS

The foregoing and other features of the present invention will become apparent to those skilled in the art to which the present invention relates from reading the following description with reference to the accompanying drawings, in which.

DETAILED DESCRIPTION OF THE INVENTION

Figure 1:
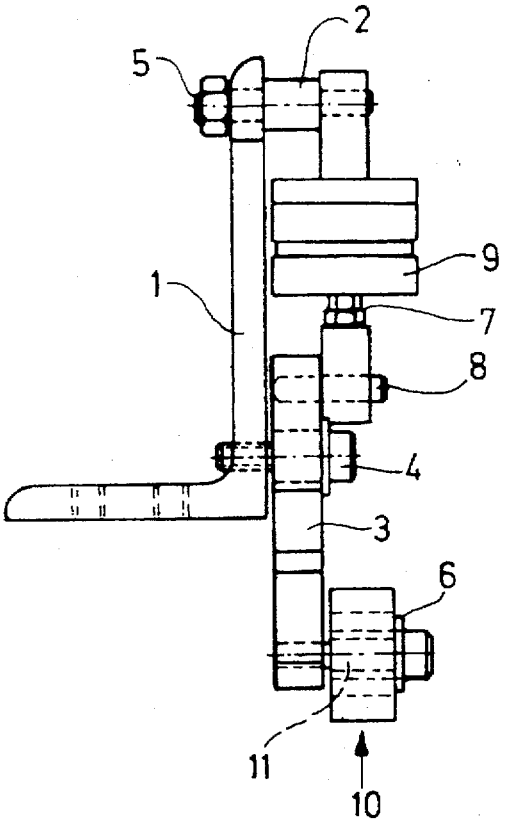
FIG. 1 is a side view of the ejector assembly.

FIG. 1 shows a side view of an assembly used in the present invention to create a nip for ejecting loosely-held signatures. On a bracket 1 there is mounted, by a stud 2, an actuating element 9. The stud 2 is fastened to the bracket 1 by a nut 5. The actuating element 9 includes a rod having a nut 7, and is linked to an actuating lever 3. The linkage between the rod of the actuating element 9 and the actuating lever 3 is a dowel pin 8. The lever 3 pivots about a pivot axis 4 on the bracket 1 and is turned by the actuating element 9 around the pivot axis 4. On the opposite end of the actuating lever 3 is mounted a rotatably mounted surface 10, which rotatably mounted surface rotates about an axis of rotation 11. The rotatably mounted surface 10 can be of any known type, e.g., a rubber roll, rubber disc or a rubber-coated discshaped element, and is kept in position on pivot axis 4 by a retaining ring 6.

Actuating lever 3 is pivotable upon actuation of the actuating element 9. The actuating element 9—which may be a pneumatic cylinder, an encapsulated hydraulic cylinder, solenoids, an electric motor, or actuating spindles driven by a motor—brings the second rotatably mounted surface 10 into and out of engagement with a driven surface on driven roller 15 (see FIG. 3). The second rotatably mounted surface 10 can be a continuous roller which extends over the width of a product transfer area 14 within the nip of product conducting cylinders 12, 13 of the folding apparatus. The second rotatably mounted surface 10 can additionally be formed of axially-spaced discs which are spaced apart from one another over the width of the product transfer area 14.

Figure 2:
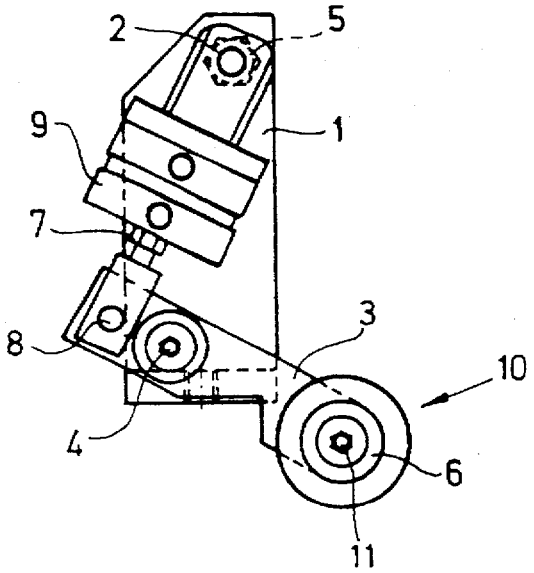
FIG. 2 is a front view of the ejector assembly.

FIG. 2 shows the signature ejecting assembly in front view. As can be seen in FIG. 2, the actuating element 9 is pivotally mounted on the bracket 1 and actuates one end of the actuating lever 3, which lever has the second rotatably mounted surface 10 attached thereto. As a result, the second rotatably mounted surface 10 is moved around pivot axis 4 upon actuation of actuating element 9.

Figure 3:
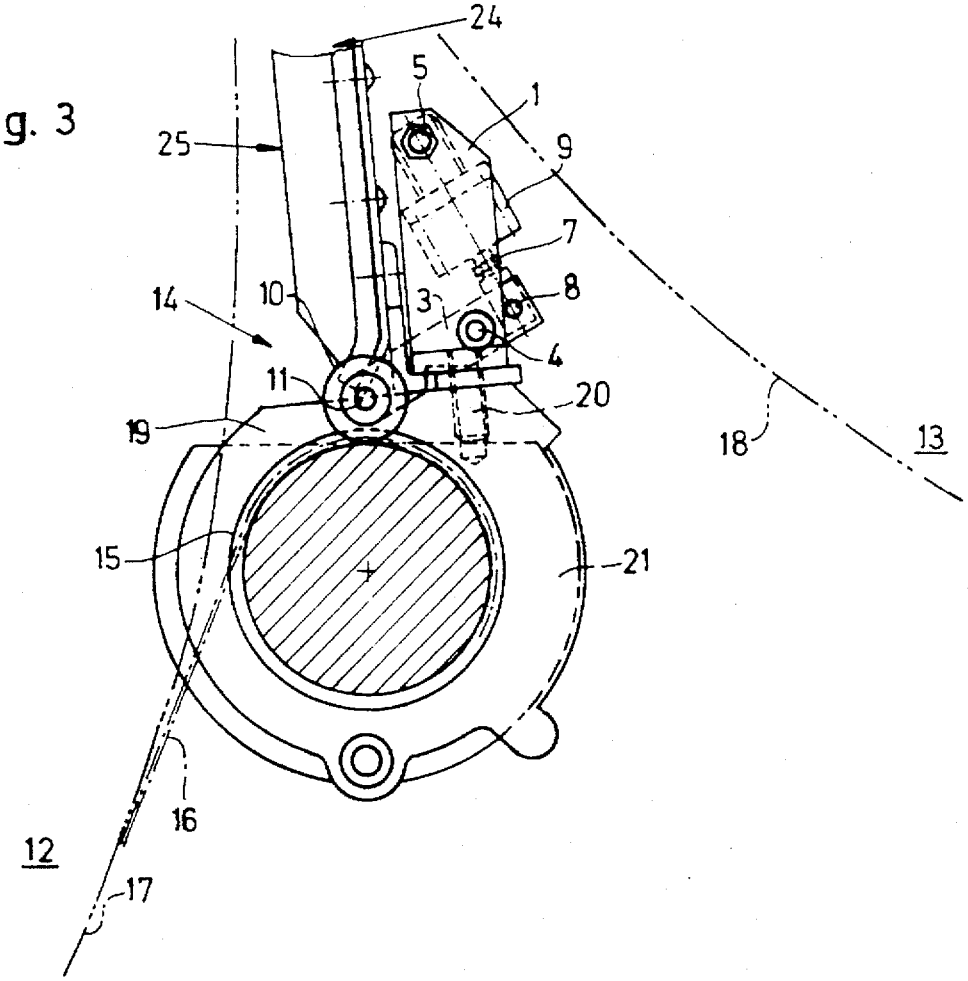
FIG. 3 shows a product transfer area within a folding apparatus.

FIG. 3 shows a product transfer area 14 within a folding apparatus which includes the apparatus of the present invention. Two cooperating product guiding cylinders 12, 13—one of which, i.e., cylinder 12, is a tucking blade cylinder and the other of which, i.e., cylinder 13, is a jaw cylinder, collecting cylinder or the like—form a nip or product transfer area 14 in which products or signatures are transferred from a surface 17 of the first product guiding cylinder 12 to a respective surface 18 of the second product guiding cylinder 13. Within the product transfer area ! 4 is located a driven roller 15. The driven roller 15 can be the roller which guides high-speed conveyor tape 16 assigned to the surface 17 of the first product guiding cylinder 12.

Within the product transfer area or nip 14 is located the signature ejecting assembly according to the present invention. The second rotatably mounted surface 10 is mounted on the actuating lever 3, which lever 3 is actuated by the actuating element 9. As can be seen in FIG. 3, the second rotatably mounted surface 10 contacts the surface of the driven roller 15. The second rotatably mounted surface 10 is preferably mounted adjacent those areas of the driven roller 15 where no circumferential recesses are located. As a result, the second rotatably mounted surface 10 contacts the upper surface of the driven roller 15, thus creating a nip between the second rotatably mounted surface 10 and the driven roller 15.

Figure 5:
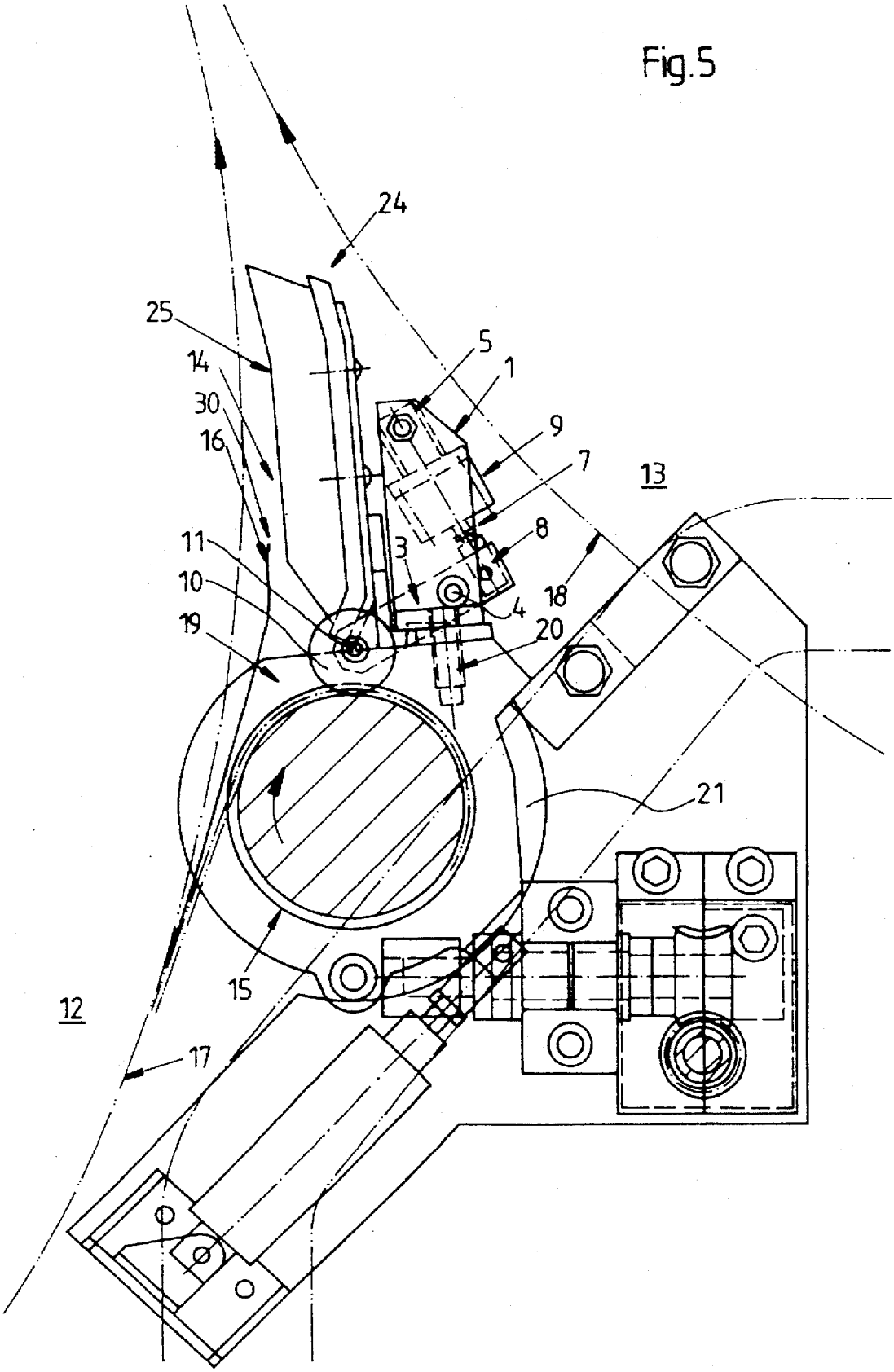
FIG. 5 shows the product transfer area of the present invention when a loosely-held signature enters that area.

Particularly during start-up of a rotary printing press, the signatures 16 tend to be loosely restrained against the surface of a product guiding cylinder, such as the cylinder 12, as is shown in FIG. 5. The signatures are only held against the surface of the cylinder (e.g., cylinder 12 in FIGS. 3 and 5–7) by tapes 16 in this condition. When the signatures reach the fold-off point in the product transfer area 14, they are released without securely being gripped by signature seizing devices on the cylinder 12. As a result, an end 30 of signature 16 is loose within the product transfer area 14. Because even during start-up, a continuous flow of signatures is being provided to product transfer area 14, the loose signatures 16 can bunch up and cause a jam in the product transfer area 14.

Figure 6:
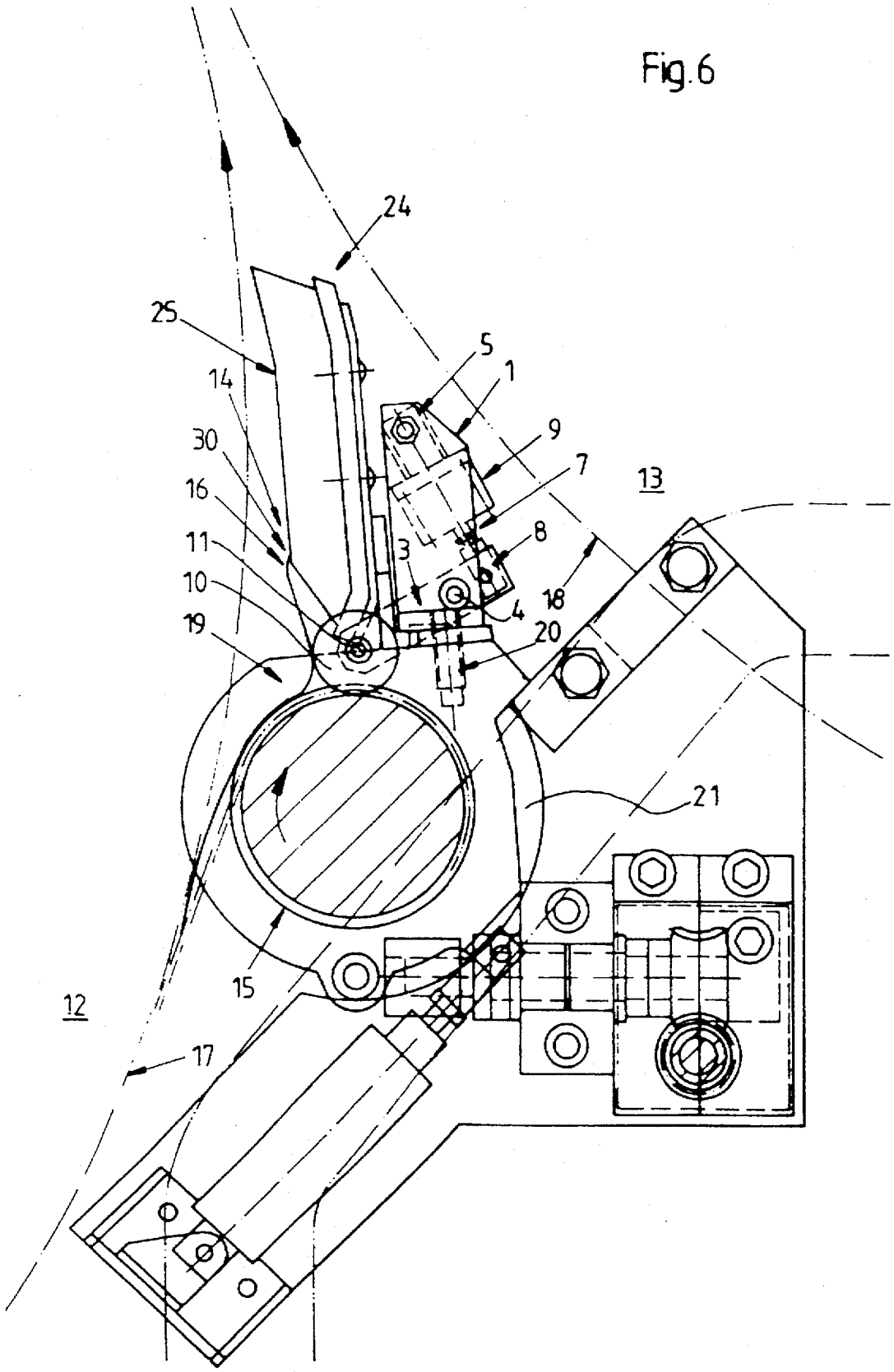
FIG. 6 shows the product transfer area of the present invention when a loosely-held signature begins to bunch in that area.

FIG. 6 shows the manner in which it has been found that signatures 16 bunch up in the product transfer area 14. The end 30 of a loosely held signature 16 tends to catch on the guide 25 in product transfer area 14, which guide 25 is preferably in the form of a brush, in product transfer area 14, creating a bunched area 31 in signature 16. This bunched area 31, upon further rotation of cylinder 12, can result in a jam created in product transfer area 14. The apparatus of the present invention prevents the bunched area 31 from becoming a jam, by ejecting any signature 16 which becomes bunched.

Figure 7:
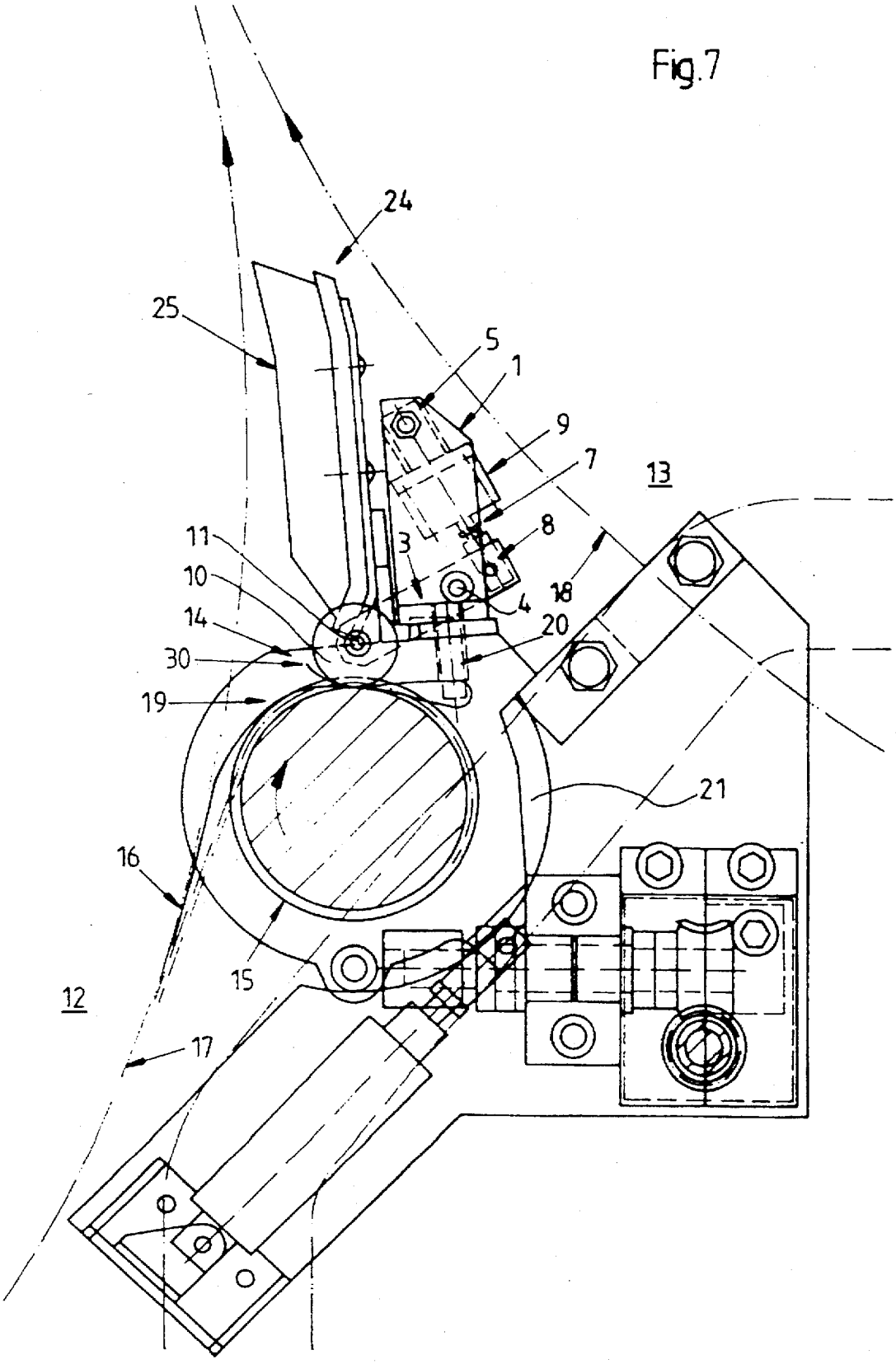
FIG. 7 shows the product transfer area of the present invention when a loosely-held signature is ejected from that area.

Upon actuation of the actuating element 9, which actuation is generally timed to correspond with start-up of the printing press, the second rotatably mounted surface 10 is gently pressed against the surface of the driven roller 15. This movement results in a nip being created between the second rotatably mounted surface 10 and the driven roller 15. The second rotatably mounted surface 10 is driven by friction between it and the driven roller 15. As shown in FIG. 7, the rotating surfaces 10, 15 seize loosely restrained signatures 16 which have become bunched, at the location of bunched area 31, exerting a positive drive upon the signature 16. As a result, the bunched signatures 16 are ejected out of the potential jam site, in the direction of arrow E in FIG. 7.

Although shown in the preferred embodiment as being pneumatic actuating cylinders, actuating elements 9 could alternatively be, for example, solenoids or electric motors, encapsulated hydraulic cylinders or motor-driven spindles. As is apparent from FIG. 3, the bracket 1 can be mounted by screws 20 or the like on a support 19. The bracket 1 may be mounted on a support 24 which is attached to a guide 25 extending over the width of the product transfer area 14. Single signature ejecting assemblies can be distributed and mounted over the width of the product transfer area 14, such that the ejecting assemblies are accurately spaced from one another along the width.

Figure 4:
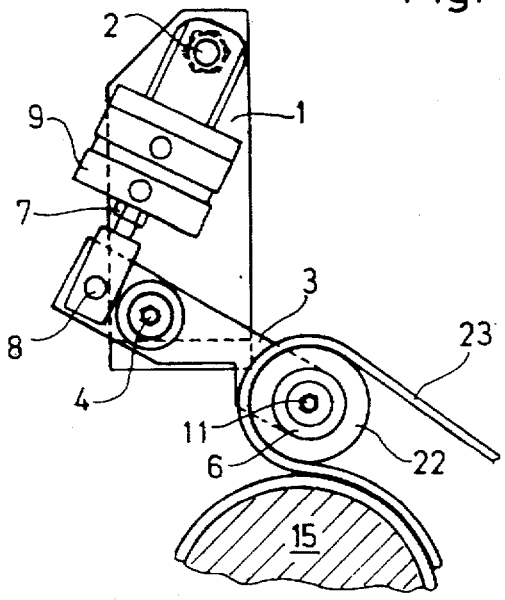
FIG. 4 shows a further embodiment of the signature assembly.

FIG. 4 shows an alternative embodiment of the second rotatably-mounted surface 10. In the embodiment of FIG. 4, a roll 22 is mounted on the actuating lever 3 for rotation about rotating axis 11. On the roll 22 a belt 23 is mounted, which rotates upon contact with the driven roller 15. Thus, the belt 23, upon actuation of the lever 3, creates a nip area 21 with the driven roller 15 and the driven roller drives the belt 23, such that a positive drive upon loosely restrained signatures which have bunched is exerted to convey the signatures out of the product transfer area 14.

From the above description of the invention, those skilled in the art will perceive improvements, changes and modifications. Such improvements, changes and modifications within the skill of the art are intended to be covered by the appended claims.

What is claimed is:

1. A signature ejecting assembly in a folding apparatus comprising:

a first rotatably mounted surface, the first rotatably mounted surface being driven; and a second rotatably mounted surface, the second rotatably mounted surface being movably mounted on a bracket, the first and second rotatably mounted surfaces being located within a product transfer area of the folding apparatus, the second rotatably mounted surface exerting a positive drive upon signatures, to thereby eject signatures from the product transfer area, the second rotatably mounted surface being movable against the first rotatably mounted surface, wherein movement of the second rotatably mounted surface against the first rotatably mounted surface creates a nip.

2. The signature ejecting assembly of claim 1, wherein:

the first rotatably mounted surface is a conveyor tape roller.

3. The signature ejecting assembly of claim 2, wherein:

the first rotatably mounted surface is a high-speed conveyor tape roller assigned to a first product guiding cylinder of the folding apparatus.

4. The signature ejecting assembly of claim 1, wherein:

the second rotatably mounted surface is a rubber roller.

5. The signature ejecting assembly of claim 1, wherein:

the second rotatably mounted surface is a rubber disc.

6. The signature ejecting assembly of claim 1, wherein:

the second rotatably mounted surface is a belt.

7. A signature ejecting assembly in a folding apparatus comprising:

a first rotatably mounted surface, the first rotatably mounted surface being driven; and a second rotatably mounted surface, the second rotatably mounted surface being movably mounted on a bracket, the first and second rotatably mounted surfaces being located within a product transfer area of the folding apparatus, the second rotatably mounted surface exerting a positive drive upon signatures, to thereby eject signatures from the product transfer area, the second rotatably mounted surface being movable against the first rotatably mounted surface by an actuating element.

8. The signature ejecting assembly of claim 7, wherein: the actuating element is a pneumatic cylinder.

9. The signature ejecting assembly of claim 7, wherein: the actuating element is a solenoid.

* * * * *